United States Patent [19]

Musto

[11] 4,257,761

[45] Mar. 24, 1981

[54] MULTIPLE JET COAL BURNER

[75] Inventor: Richard L. Musto, Homewood, Ill.

[73] Assignee: Combustion Engineering, Inc., Windsor, Conn.

[21] Appl. No.: 21,734

[22] Filed: Mar. 19, 1979

[51] Int. Cl.[3] ..... F23C 5/00

[52] U.S. Cl. ..... 431/174; 239/558

[58] Field of Search ..... 431/174; 239/552, 553.5, 239/558

[56] References Cited

U.S. PATENT DOCUMENTS

| | | | |
|---|---|---|---|
| 1,960,609 | 5/1934 | Werner | 431/174 |
| 2,054,601 | 9/1936 | Jenkins | 239/558 |
| 2,518,543 | 8/1950 | Hasse | 239/558 |
| 3,519,396 | 7/1970 | Eagle et al. | 239/558 |
| 3,822,110 | 7/1974 | Paredes et al. | 431/174 |
| 4,035,137 | 7/1977 | Arand | 431/174 |
| 4,119,152 | 10/1978 | Koyama | 239/553 |
| 4,169,700 | 10/1979 | Yoshioka et al. | 431/174 |

FOREIGN PATENT DOCUMENTS

| | | | |
|---|---|---|---|
| 152551 | 7/1953 | Australia | 431/174 |
| 788597 | 10/1935 | France | 239/558 |
| 2234817 | 1/1975 | France | 239/558 |

*Primary Examiner*—Joseph Man-Fu Moy
*Attorney, Agent, or Firm*—Arthur E. Fournier, Jr.

[57] ABSTRACT

A burner of relatively small BTU rating embodying a multiplicity of jets and particularly suited for burning pulverized coal in small air heater or furnace applications. The subject burner includes a housing having first inlet means formed at one end thereof and outlet means formed at the other end thereof. The first inlet means is connectable to a pipe means through which pulverized coal and primary air are fed from a suitable source thereof to the burner. The burner is further provided with second inlet means, the latter being formed in the burner housing so as to be located therein in close proximity to the aforesaid first inlet means. The second inlet means is connectable to a suitable source of secondary air from where secondary air is fed to the burner. Both the first inlet means and the second inlet means are operatively connected in fluid flow relation with the outlet means of the burner whereby the primary air, the pulverized coal and the secondary air are all discharged from the burner at the outlet end thereof. A multiplicity of jets are embodied in the burner extending substantially the length thereof. Additionally, the burner includes spacing means operative for spacing the multiplicity of jets one from another in supported relation within the burner housing, and for defining a plurality of flow paths for the secondary air through the burner housing. Finally, there are provided mounting means operative for cooperatively associating the burner with a small air heater, or small furnace, or other functionally similar piece of equipment.

2 Claims, 4 Drawing Figures

MULTIPLE JET COAL BURNER

BACKGROUND OF THE INVENTION

This invention relates to coal firing systems, and, more specifically, to a burner of relatively small capacity that is particularly suited for use in small air heater or furnace applications.

Coal fired systems per se are not new. That is to say, the prior art is replete with examples of various types of coal-fired systems that have heretofore been available in the prior art for purposes of fulfilling the requirements of a multiplicity of diverse applications. However, irrespective of the particular form which the coal-fired system may take or the particular application in which it is being utilized, there is one major operating component which all such coal-fired systems embody; namely, a burner.

Basically speaking, the function of any type of burner, regardless of whether the burner is designed for burning coal or some other type of fuel, is to supply air and fuel to a combustion chamber in the amounts required to support the combustion of the fuel in the chamber. More specifically, desirably the burner should be operative to supply air and fuel to the combustion chamber in such a manner as to produce the following: stability of ignition; effective adjustment for control of ignition point and flame shape; completeness of combustion; uniform distribution of excess air and temperature leaving the combustion chamber; freedom from localized slag deposits; protection against overheating, internal fires and excessive wear in the burner; and accessibility for adjustment and maintenance.

Coal has long been one of this nation's most abundant sources of fuel. At one time earlier in this century, much of the nation's energy needs were being met through the use of coal. Then, a decline set in in the degree to which coal was being employed to generate power. Much of this decline stemmed from the increased usage of oil and gas as sources of fuel. More recently, the power being generated from the burning of oil and gas has been supplemented by the use of nuclear fuel for power producing purposes. However, with the advent of the oil embargo earlier in this decade, which was accompanied by sharp increases in the price of oil and the existence of restricted oil supplies, and the increased concern, which has since been expressed over the rate at which the world's known oil reserves are being depleted, coal has begun to regain much of the favor, which it once had, as a source of fuel to meet the nation's energy needs. To an increasing extent, this has been evidenced in the number of orders which have been placed in recent years, for power generating systems that are to be coal-fired systems as well as the extent to which increased interest is being shown in effecting the conversion of existing oil- and gas- fired power generating systems to coal-fired systems.

By and large, however, the shift, which has been taking place, from oil and/or gas back to coal has been limited to relatively large applications. For purposes of this discussion, a large application is considered to be any application wherein there is a need to provide a heat input, which is in excess of fifty million BTU/Hr. Furthermore, insofar as concerns the coal-fired applications to which reference is had herein, it should be noted that the form of coal, which is actually being burned therein, is pulverized coal. Finally, note is taken of the fact that the coal-fired systems that are presently being marketed embody many significant advances as compared to coal-fired systems of earlier vintage. For the most part though, the focus insofar as concerns the state of the art of coal-fired systems has been on increasing the heat input obtainable from a given coal-fired system and/or rendering the coal-fired system as non-pollutant as required to achieve air pollution standards, etc. In summary, the advances, therefore, which have been alluded to above, now render it possible to offer in the marketplace coal-fired systems of increasingly larger rating as compared to the coal-fired systems that have previously been available.

As noted previously hereinabove, two important factors to which consideration must be given in providing burners of any type, including those intended for utilization in coal-fired systems as one of the major operating components thereof, are flame length and flame stability. It is well recognized by those skilled in the art that the length of the flame produced in the course of the operation of a coal burner wherein pulverized coal is being burned is measurably longer than the length of the flame produced by an oil or gas burner of the same relative rating. The longer flame length in the case of the coal burner is attributable principally to the need to effect the proper mixture of air and fuel required to support combustion. Namely, the mixture of primary air and pulverized coal, which is fed to the coal burner, must be supplemented with secondary air to provide the proper ratio for the combustion of the air and the fuel. More specifically, there is a need to effect the infusion of the oxygen from the air through the carbon particles contained in the pulverized coal in order that combustion may occur. The result, consequently, is a relatively long flame as compared to the flame produced from either oil or gas.

As regards the matter of flame stability, the latter is dependent upon the amount of heat, which is readily available from the fuel that is already burning in the combustion chamber. Generally speaking, flame stabilization is commonly achieved by virtue of a strong vortex, which is created in the combustion chamber and which is operative to divert hot gases of combustion back toward the incoming fuel stream being discharged from the burner.

From the foregoing, it should be readily apparent that a definite relationship exists between combustion chamber size, i.e., furnace area, and the capacity to develop a flame of suitable length and stability. Heretofore, for the most part, furnace area has not been a limiting factor in the employment of prior art forms of coal burners as relates to their ability to achieve therewith, desired flame length and flame stability. This is because the furnace area, i.e., combustion chamber size, has been of sufficiently large dimensions as to not impose any limitations on generating a flame of the desired length. Likewise, there has existed sufficient area therewithin for the development of the strong vortex needed to effect flame stabilization. Moreover, insofar as concerns the conversion of existing facilities to coal or the building of new facilities designed to employ coal-fired systems, the trend has been towards larger capacity units wherein size limitations are not a factor with regard to the attainment of suitable flame length and/or flame stability. This trend towards the utilization of coal rather than oil or gas in connection with such larger capacity units is quite natural. Namely, in the face of a need to conserve scarce natural resources, it is not to be unexpected that attention would be turned first to applications that involve the consumption of larger quantities of fuel and, accordingly, applications in which there exists the potential of achieving the largest savings of fuel.

Recently, however, increasing attention has been directed towards the effectuation of the conversion from oil or gas to coal of even those thermal processes that require heat inputs of relatively small magnitude, i.e., heat inputs of between one million and fifty million BTU/Hr. Much of this is attributable, at least in part, to the continuing rise in the price of oil and gas, and, in part, to a better appreciation by users of oil and gas of their vulnerability to the imposition of restrictions on their usage of oil or gas. Moreover, as a consequence of this increased interest, a need has been established for a new form of coal-fired system that would be suitable for use in those applications wherein heat inputs of between one million and fifty million BTU/Hr. are required. More specifically, the interest in converting more and more of the thermal processes that involve the utilization of relatively small amounts of heat input from oil and gas to coal has generated a need for a coal burner suitable for use in small air heater or furnace applications; namely, a need for a coal burner that is capable under such circumstances of providing a flame of relatively short length accompanied by the desired degree of flame stability. The reason for the need for such a coal burner stems from the fact that the relatively confined nature of the combustion chamber that such small air heaters or furnaces embody renders existing coal burners generally unsuitable for use therein. That is, it is difficult with known forms of coal burners to attain the short flame length and flame stability that desirably should be present during combustion. This is because of the constraints due to size that are imposed by virtue of the fact that the combustion chambers in the aforereferenced small air heaters and furnaces are of relatively small dimensions.

It is, therefore, an object of the present invention to provide a new and improved burner suitable for use in burning, particularly pulverized coal.

It is an another object of the present invention to provide such a burner of relatively small BTU rating.

It is still another object of the present invention to provide such a burner, which is particularly suited for use in small air heater and furnace installations requiring heat inputs of between one million and fifty million BTU/Hr.

A further object of the present invention is to provide such a burner, which embodies a multiplicity of jets, each defining an individual path of flow for fuel through the burner.

A still further object of the present ivnention is to provide such a burner, a characteristic of which is the relatively short flame length that is produced thereby.

Yet another object of the present invention is to provide such a burner with which it is possible to attain short flame length as well as flame stabilization.

Yet still another object of the present invention is to provide such a burner, which is capable of being employed as original equipment in the case of new installations equipped with coal-fired systems, as well as being capable of employing as a replacement burner in the case of existing installations that are being converted from oil- or gas- fired systems to coal-fired systems.

Yet still a further object of the present invention is to provide such a burner, which is advantageously characterized by the fact that because of low turbulence or vortex, it has a low pressure drop, and therefore requires only low primary and secondary air fan horsepower.

SUMMARY OF THE INVENTION

In accordance with the present invention, there is provided a burner of relatively small BTU rating, which is particularly suited for use in small air heater and furnace applications. The subject burner includes a housing having a first inlet formed therein at one end thereof and an outlet formed therein at the other end thereof. Extending from the aforesaid first inlet thereof to the outlet end thereof and in fluid flow communication therewith, there are provided in the housing a multiplicity of jets. Each of the jets defines a separate path of flow for fuel through the burner housing. Spacing means are embodied within the burner housing operative to effect the spacing of the multiplicity of jets one from another in supported relation relative to the internal side walls of the burner housing. The burner is further provided with a second inlet formed in the housing thereof at a location adjacent to the first inlet. The first inlet is connectable in fluid flow relation to a source of primary air and pulverized coal for receiving therefrom a mixture thereof. The second inlet is connectable to a source of secondary air, which is supplied therefrom to the burner. The second inlet is suitably formed in the burner housing so that the secondary air enters the burner substantially at right angles to the path of flow of the primary air and pulverized coal through the burner. The aforementioned spacing means is further operative to establish a plurality of individual flow paths of the secondary air through the burner housing. Finally, the burner includes mounting means operative for cooperatively associating the burner with a small air heater, or another functionally similar piece of equipment.

DESCRIPTION OF A PREFERRED EMBODIMENT

Figure 1:
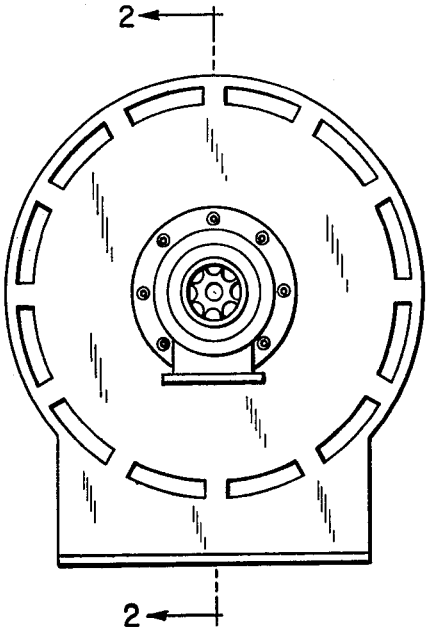
FIG. 1 is a side elevational view of an air heater embodying a coal burner, constructed in accordance with the present invention.
Figure 2:
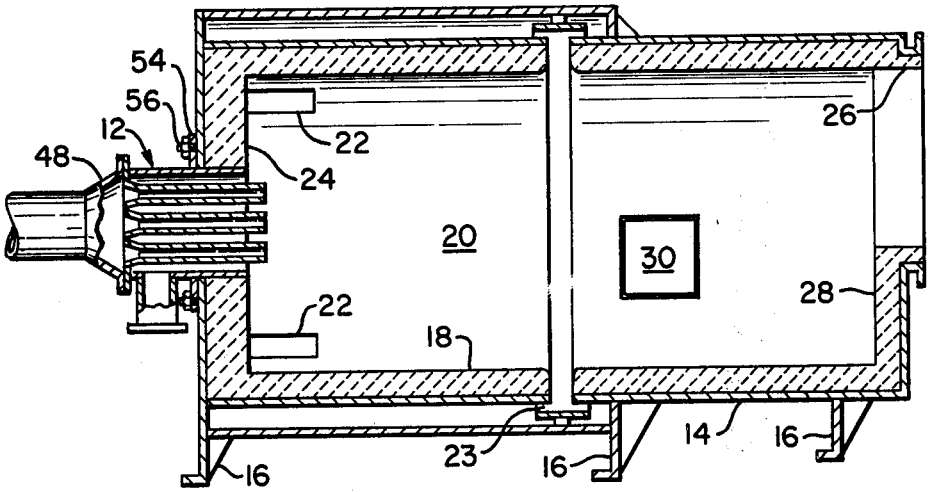
FIG. 2 is a cross-sectional view of the air heater of FIG. 1, taken substantially along the line 2—2 in FIG. 1.

Referring now to the drawing, and, more particularly, to FIGS. 1 and 2 thereof, there is depicted therein an air heater, generally designated by reference 10, embodying a coal burner, generally designated by reference 12, constructed in accordance with the present invention. Although the coal burner 12 of the present invention is depicted in FIG. 1 and 2 of the drawing as being cooperatively associated with the air heater 10, it is to be understood that the coal burner 12 could equally well have been shown associated with a small industrial furnace, or some other functionally similar piece of equipment, without departing from the essence of the present invention. Namely, the association of the coal burner 12 with the air heater 10 is intended to merely exemplify one of the applications in which the coal burner 12 of the present invention is suited for use, and is not to be understood as being limited thereto.

Inasmuch as the air heater 10 is of a conventional construction, which is well known to those skilled in the art, it is not deemed necessary to set forth herein a detailed description of the air heater 10. Rather, it is deemed sufficient for purposes of obtaining an understanding of the coal burner 12 of the present invention to merely present herein a brief description of the nature of the construction and the mode of operation of the air heater 10. To this end, and with further reference to FIG. 1 and 2 of the drawing, the air heater 10, as shown in FIG. 1, embodies a generally cylindrical configuration. More specifically, the air heater 10 includes a generally cylindrical housing 14, which is supported on a frame structure 16 that, in turn, is preferably designed to be securely fastened to a suitable floor-like surface (not shown).

Continuing with the description of the air heater 10, the housing 14 thereof is internally lined in conventional fashion with a suitable refractory material 18. The latter refractory material 18 is operative to define the configuration of the area within the air heater 10 wherein combustion occurs, i.e., the internal area of the air heater 10 which is operative as the combustion chamber thereof. This area, i.e., the combustion chamber of the air heater 10, is identified by the reference numeral 20 in FIG. 2 of the drawing.

As its name implies, the use to which the air heater 10 is intended to be put is that of effecting the heating of air. To this end, the air heater 10 is provided with a plurality of inlet openings 22, which in accordance with the illustrated embodiment of the air heater 10 comprise six in number, and an annular slot 23, through which air passes from the exterior of the air heater 10 to the interior thereof. Although not shown in the drawing in the interest of maintaining clarity of illustration therein, it is to be understood that in accordance with the practice commonly followed in the art of air heaters, each of the inlet openings 22 has associated therewith a damper (not shown) that is operative to effectuate the closing and the opening of the inlet openings 22 as required to control the combustion chamber temperature. Furthermore, in accordance with the illustrated embodiment of the air heater 10, the inlet openings 22 are preferably provided in equally spaced relation one to another around the circumference of the air heater 10 and so as to be located adjacent to the front wall 24 of the air heater 10. A suitable exit opening 26 is formed in the rear wall 28 of the air heater 10 through which the air after being heated within the housing 14 exits from the air heater 10. Finally, mention is made of the fact that access to the interior of the air heater 10 is provided through an access door 30, which is suitably formed in the circumference of the air heater 10 at a location, that as seen with reference to FIG. 2, is in closer proximity to the rear wall 28 than it is to the front wall 24.

Figure 3:
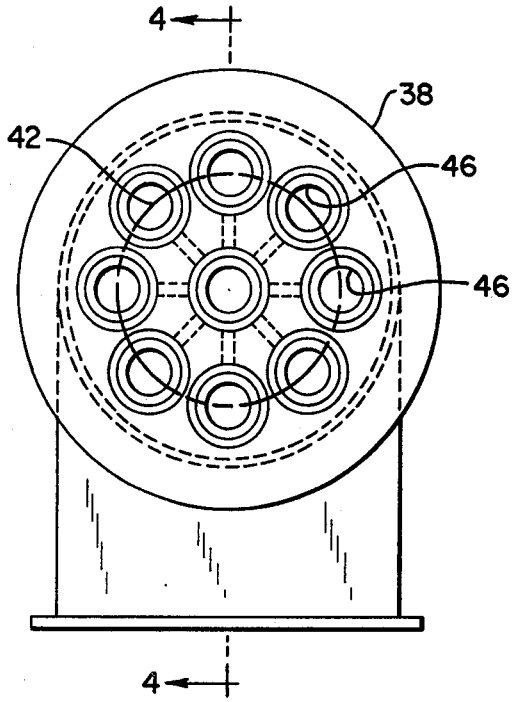
FIG. 3 is a side elevational view of a coal burner constructed in accordance with the present invention.
Figure 4:
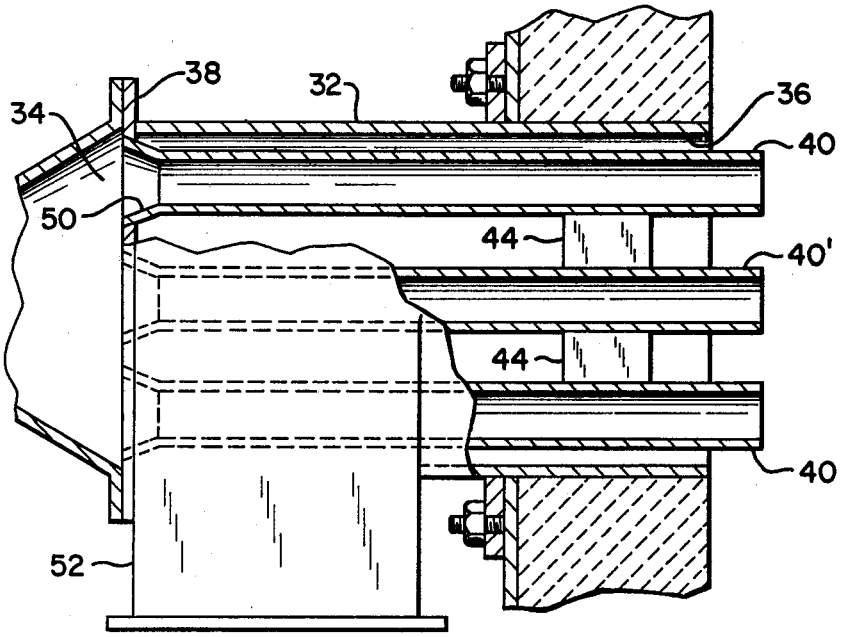
FIG. 4 is a cross-sectional view of the coal burner of FIG. 3, taken substantially along the line 4—4 in the FIG. 3.

Turning now to a consideration of the coal burner 12, reference will be had for this purpose, particularly to FIGS. 3 and 4 of the drawing. As depicted therein, the coal burner 12 includes a housing 32 of generally cylindrical configuration. The housing 32 has a first inlet 34 formed therein at one end thereof for a purpose yet to be described, and an outlet 36 formed therein at the opposite end thereof. The end of the housing 32, which is provided with the first inlet 34, has also located thereat a circular flange member 38. The latter flange member 38 may be suitably affixed to the housing 32 in any conventional manner, such as for instance, by being welded thereto, or through the employment of any other conventional method of securing metal members together.

Continuing with a description of the nature of the construction of the coal burner 12, the latter further includes a multiplicity of jets 40. In view of the identicalness of their construction, each of the aforereferenced multiplicity of jets has been identified in the drawing by the same reference numeral, i.e., reference numeral 40. In accord with the best mode embodiment of the invention, the jets 40, as best understood with reference to FIG. 4 of the drawing are located within and extend the entire length of the housing 32. Namely, each of the multiplicity of jets 40 extends within the housing 32 from the first inlet 34 thereof to the outlet 36 thereof. Moreover, as illustrated in FIG. 3 of the drawing, the multiplicity of jets 40 in accord with the best mode embodiment thereof are arranged in suitably spaced relation one to another so that their centers define the circumference of a circle, the latter being denoted in FIG. 3 by reference numberal 42, except for one of the jets, which, for purposes of distinguishing it from the remainder of the multiplicity of jets 40, has had a prime added to its reference numeral 40 so that the latter appears as 40 prime. The latter one of the multiplicity of jets, i.e., jet 40 prime, is itself located at the center of the circle 42. Each of the multiplicity of jets 40, 40 prime, is suitably connected in fluid flow relation at one end thereof with the first inlet 34 of the housing 32 and is suitably connected at the other end thereof with the outlet 36 of the housing 32. As such, the multiplicity of jets 40, 40 prime, are each operative to define a separate and distinct flow path through the housing 32 for fluids entering the housing 32 through the first inlet 34 thereof and exiting therefrom through the outlet 36 thereof.

In accord with the illustrated embodiment of the invention, the coal burner 12 is provided with spacer means operative to effect the spacing of the multiplicity of jets 40, 40 prime, one from another and to provide support adjacent to the outlet 36 of the housing 32 to the ends of the multiplicity for jets 40, 40 prime, so as to thereby insure that the multiplicity of jets 40, 40 prime are maintained in properly mounted relation relative to the interior of the housing 32. The aforereferenced spacer means, as depicted in FIG. 4, consists of a multiplicity of spacer members, each designated in the drawing by the same reference numeral 44. Preferably, the multiplicity of spacer members 44 comprise one less in number, i.e., eight, than the number of jets 40, 40 prime with which the coal burner 12 is provided. Each of the spacer members 44, as best understood with reference to FIG. 4 of the drawing is of relatively short length, and has one edge thereof cooperatively associated, in any suitable fashion, with one of the multiplicity of jets 40 and another edge thereof cooperatively associated, in any suitable fashion, with the jet 40 prime. Namely, the spacer member 44 are operative to space each of the multiplicity of jets 40 relative to the jet 40 prime located at the center of the circle 42 and also relative to the pair of jets 40 located adjacent thereto on either side thereof. By way of exemplification, the spacer members 44 may be cooperatively associated with corresponding ones of the multiplicity of jets 40, 40 prime, such as by being welded thereto. Note should also be taken of the fact that the spacer members 44 are also operative to define a series of flow paths between the multiplicity of jets 40, 40 prime, i.e., between the jet 40 prime and each adjoining pair of jets 40.

Although the coal burner 12 has been shown as being provided with one particular form of spacer means, it is to be understood that the coal burner 12 could equally well be provided with some other functionally equivalent form of spacer means, without departing from the essence of the present invention. Morever, it is understood that the multiplicity of jets 40, 40 prime, could be arranged in some other fashion within the interior of the housing 32 without departing from the essence of the invention. Similarly, as alluded to in the foregoing, the housing 32 could embody some other shape other than a cylindrical configuration, such as for instance, a rectangular shape wherein the multiplicity of jets 40, 40 prime, could embody a rectangular pattern rather than a circular pattern as shown in the drawing. Finally, the multiplicity of jets 40, 40 prime, could consist of a somewhat greater or a somewhat lesser number of jets than the nine provided in the coal burner 12 in accord with the best mode embodiment of the invention, without departing from the essence of the invention.

With further regard to the multiplicity of jets 40, 40 prime, the latter each have their other end positioned, through the use of any suitable conventional form of positioning means, so as to be located within the first inlet 34 of the housing 32. More specifically, the multiplicity of jets 40, 40 prime, are suitably located so as to be each capable or receiving a mixture of primary air and pulverized coal, which is being fed to the coal burner 12 from a suitable source (not shown) thereof, in a manner to be more fully described subsequently. At this point, however, it is deemed sufficient to merely note that a mixture of primary air and pulverized coal enters each of the multiplicity of jets 40, 40 prime, through the first inlet 34 of the housing 32 and flows through the multiplicity of jets 40, 40 prime, in separate and distinct flow paths, whereupon the mixtures of primary air and pulverized coal are discharged from the coal burner 12 through the outlet 36 of the housing 32. It should be further noted here that the mixture of primary air and pulverized coal that flows through any particular one of the multiplicity of jets 40, 40 prime, is isolated from the mixture of primary air and pulverized coal that flows through each of the remaining ones of the multiplicity of jets 40, 40 prime. Namely, at the first inlet 34 of the housing 32, the mixture of primary air and pulverized coal being fed to the coal burner 12 as one stream thereof, becomes divided and flows through the housing 32 as a multiplicity of streams thereof, with the number of streams of mixtures of primary air and pulverized coal corresponding in number to the number of jets 40, 40 prime, embodied in the coal burner 12, i.e., nine. The nine streams of mixtures of primary air and pulverized coal are also discharged from the coal burner 12 as a multiplicity of streams, rather than as one single stream consisting of a mixture of primary air and pulverized coal.

In accord with the best mode embodiment of the invention, the division of the single mixed stream of primary air and pulverized coal into a multiplicity of mixed streams of primary air and pulverized coal is accomplished in the following manner: The circular flange member 38, to which reference has previously been had hereinbefore, consists essentially of a substantially solid plate having a multiplicity of openings 46 suitably provided therein, as best understood with reference to FIG. 3 of the drawing. Each of the openings 46 is suitably located in the circular flange member 38 so as to be aligned with a corresponding one of the multiplicity of jets 40, 40 prime, whereby a fluid flow path is established between the openings 46 and the multiplicity of jets 40, 40 prime. Furthermore, as illustrated in FIG. 2 of the drawing, the circular flange member 38 is suitably connected to one end of a pipe 48, the other end of which is suitably connected in fluid flow relation to a source (not shown) of a mixture of primary air and pulverized coal. The pipe 48 is operative to supply to the first inlet 34 of the coal burner 12 the desired mixture of primary air and pulverized coal in the form of a single stream thereof. For purposes of effecting the connection of the circular flange member 38 to the pipe 48, any suitable form of conventional connecting means may be employed such as, for instance, conventional threaded fasteners that are receivable within threaded nuts.

With the pipe 48 connected to the member 38, as described above, the mixed stream of primary air and pulverized coal flowing through the former when it encounters the member 38 is deflected by virtue of the substantially solid nature of the latter into the openings 46 and thereby into the multiplicity of jets 40, 40 prime, for passage through the coal burner 12. Namely, the substantially solid nature of the flange member 38 functions in the manner of a barrier preventing the mixed stream of primary air and pulverized coal from entering the coal burner 12 from the pipe 48 except through the openings 46 with which the member 38 is provided. In order to minimize the pressure drop occurring at the member 38, each of the openings 46, as best understood with reference to FIG. 4 of the drawing, is provided with a tapered portion 50. The latter tapered portions 50 effectively serve as a flared mouth portion for the multiplicity of jets 40, 40 prime.

Continuing with the description of the nature of the construction of the coal burner 12, the latter further includes a second inlet 52. The latter second inlet 52, as depicted in the drawing, is formed in the housing 32 adjacent to the location therein of the first inlet 34. However, the second inlet 52 is oriented relative to the first inlet 34 so that the major axis thereof extends substantially at right angles to the major axis of the first inlet 34. The second inlet 52 is operative to provide a supply of secondary air to the coal burner 12. To this end, although not shown in the drawing in the interest of maintaining clarity of illustration therein, the second inlet 52 is connectable to one end of a suitable pipe (not shown), the other end of which is connected in fluid flow relation to a suitable source (not shown) of secondary air. Any suitable conventional form of connecting means (not shown) such as threaded fasteners and threaded nuts could be utilized to effect the connection of the secondary inlet 52 to the secondary air supply pipe (not shown).

In accordance with the best mode embodiment of the invention, the secondary air enters the housing 32 of the coal burner 12 through the second inlet 52 at right angles to the path of flow of the primary air and pulverized coal through the housing 32. After entering the housing 32, a change is effected in the direction of flow of the secondary air whereby the seconday air is caused to flow parallel to the path of flow of the primay air and pulverized coal the length of the housing 32 and exits therefrom at the outlet 36 thereof.

It is important to note here that the flow of the mixture of primary air and pulverized coal through the housing 32 is confined to the interior of the multiplicity of jets 40, 40 prime, whereas the secondary air is confined to flowing entirely externally of the multiplicity of jets 40, 40 prime, through the housing 32. Consequently, no intermingling of the secondary air with the mixtures of primary air and pulverized coal occurs until all of the latter are discharged from the outlet 36 of the coal burner housing 32.

preferably, the amount of primary air which is mixed with the pulverized coal that flows through the multiplicity of jets 40, 40 prime, comprises approximately 10% of the amount of air required to effect the proper combustion of the pulverized coal. It is desirable that the mixture of primary air and pulverized coal being discharged from the multiplicity of jets 40, 40 prime, be a rich mixture in order to enhance the maintenance of the ignition of the pulverized coal. The balance of the air required to support the combustion of the pulverized coal is supplied in the form of secondary air. More specifically, approximately 100% of the air required to support proper combustion of the pulverized coal enters the housing 32 through the second inlet 52 and exits from the outlet 36 of the housing 32, whereupon the secondary air mixes with the primary air and pulverized coal leaving the multiplicity of jets 40, 40 prime. The exact percentage of air that is supplied as secondary air will normally vary as a function of several factors, including the type of coal to be burned, the particle size of the coal, etc. However, on the other hand, generally speaking, the figure of 10% for the amount of primary air being provided does not significantly fluctuate. In connection with the subject of primary air, note should be taken of the fact that one of the principal functions which is performed by the primary air is that of conveyor of the pulverized coal.

For purposes of initially effecting the ignition of the mixtures of air and pulverized coal being discharged from the outlet 36 of the coal burner 12, any suitable form of ignitor of conventional construction may be utilized. For example, a conventional ignitor, not shown in the drawing in the interest of maintaining clarity of illustration therein, could be suitably mounted adjacent to but spaced from and below the coal burner 12 as viewed with reference to FIG. 2 of the drawing. Namely, the ignitor (not shown) could be suitably mounted so as to protrude through the front wall of the air heater 10 in parallel relation to the coal burner 12. Once the mixtures of air and pulverized coal are initially ignited, the hot gases of combustion produced as a consequence of the burning of the individual mixtures of primary air and pulverized coal exiting from the multiplicity of jets 40, 40 prime, supplemented by the secondary air also being discharged at the outlet 36 is operative to maintain the continued ignition of the pulverized coal being subsequently discharged into the air heater 10 from the coal burner 12.

Alternatively, the jet identified by the reference numeral 40 prime in the drawing could be utilized for purposes of mounting an ignitor (not shown) of conventional construction therein, rather than as has been described above as a flow path through the coal burner 12 for a mixture of primary air and pulverized coal. In accord with such a mode of operation, such an ignitor will be utilized to simply effect the initial ignition of the air and pulverized coal, leaving the coal burner 12, whereupon the hot gases of combustion and the radiant heat produced from the burning of the previously discharged pulverized coal would be employed to maintain the continued ignition of the subsequently discharged pulverized coal.

Completing the description of the nature of the construction of the coal burner 12, the latter additionally includes mounting means. The latter mounting means, in accord with the illustrated embodiment of the invention, comprises a mounting ring 54 that is operative to mount the coal burner 12 in supported relation on the front wall 24 of the air heater 10. As shown in FIG. 1 of the drawing, the coal burner 12 is preferably positioned approximately at the center of the front wall 24 of the air heater 10. Moreover, as depicted in FIG. 2 of the drawing, the mounting ring 54 is operative to support the coal burner 12 so that the latter protrudes through the front wall 24 of the air heater 10 with both the first inlet 34 and the second inlet 52 being located external of the air heater 10 and with the outlet 36 of the coal burner housing 32 being located within the interior of the air heater 10. Furthermore, the coal burner 12 is preferably supported relative to the air heater 10 so that the major axis of the former is coaxial with the major axis of the air heater 10. Finally, the interconnection of the mounting ring 54 to the coal burner 12 and to the air heater 10 may be effected through the utilization of any suitable form of conventional connecting means. For instance, the mounting ring 54 could be welded to the housing 32 of effect the interconnection thereof to the coal burner 12, and a plurality of threaded fasteners 56 could be employed to fasten the mounting ring 54 and thereby the coal burner 12 to the exterior of the front wall 24 of the air heater 10.

In accord with the preferred mode of operation of the coal burner 12, constructed in accordance with the present invention, when cooperatively associated, by way of exemplification, with the air heater 10, the air to be heated enters the interior of the air heater 10 through the openings 22 suitably provided therein for this purpose. Concomitantly, a mixture of primary air and pulverized coal in the form of a single stream thereof is fed through the pipe 48 to the first inlet 34 of the coal burner housing 32. When this mixture of primary air and pulverized coal reaches the flange member 38, it is deflected by the substantially solid nature thereof into the openings 46 formed therein and through the tapered openings 50 associated with the latter into the multiplicity of jets 40, 40 prime. Then the primary air and pulverized coal, which has now been divided into a multiplicity of streams in order to flow past the flange 38, flows through the multiplicity of jets 40, 40 prime, in its passage through the housing 32 and is discharged therefrom at the outlet 36 thereof into the interior of the air heater 10. While the mixture of primary air and pulverized coal supplied to the coal burner 12 by means of the pipe 48 is flowing through the former in the aforedescribed manner, secondary air is fed to the second inlet 52 of the coal burner 12. After entering the coal burner 12, the secondary air flows the length of the housing 32 thereof in surrounding relation to the multiplicity of jets 40, 40 prime. The secondary air leaves the housing 32 at the outlet 36 whereupon it mixes with a multiplicity of mixed streams of primary air and pulverized coal exiting thereat from the multiplicity of jets 40, 40 prime. Ignition of the mixtures of air, primary combined with secondary, and pulverized coal is then effected. Finally, through the combustion of the pulverized coal, which is discharged along with a suitable amount of air from the outlet 36 of the coal burner 12, the air entering the interior of the air heater 10 through the annular slot 23 and the openings 22 provided therein becomes heated to the desired extent. After being so heated, this air then exists from the air heater 10 through the opening 26 provided for this purpose in the rear wall 28 of the air heater 10.

The coal burner 12 of the present invention is thus operative to provide both a flame of relatively short length and flame stabilization. Namely, in accord with the mode of operation of the coal burner 12, a plurality of individual flames, corresponding in number to the number of jets 40, 40 prime, are produced. In turn, each of the plurality of individual flames is of relatively short length, and, thus, is easily accommodated within the interior of the air heater 10, notwithstanding the relatively small dimensions thereof. Moreover, with the patterned arrangement which the multiplicity of jets 40, 40 prime embody, the hot gases of combustion and radiation produced as a consequence of the burning of the pulverized coal exiting from the multiplicity of jets 40, 40 prime, are operative to cause the effectuation of the continued ignition of the subsequently discharged pulverized coal, and accordingly, the flame stabilization desired.

Thus, in accordance with the present invention, there has been provided a new and improved burner suitable for use in burning particularly pulverized coal. Moreover, the subject burner of the present invention is characterized by its relatively small BTU rating. In addition, in accord with the present invenion, a burner has been provided, which is particularly suited for use in small air heater and furnace installations requiring heat inputs of between one million and fifty million BTU/Hr. Further, the burner of the present invention is characterized in that it embodies a multiplicity of jets, each defining an individual path of flow for fuel through the burner. Additionally, in accordance with the present invention, a burner is provided having as one of the characteristics thereof the relatively short flame length that is produced thereby. Also, the burner of the present invention is characterized in that it is possible therewith to attain a short flame length as well as flame stablization. Furthermore, in accord with the present invention, a burner has been provided that is capable of being employed as original equipment in the case of new installations equipped with coal-fired systems as well as being capable of employment as a replacement burner in the case of existing installations that are being converted from oil- or gas-fired systems to coal-fired systems. Finally, the burner of the present invention is relatively economical to manufacture, relatively easy to install and which is capable of providing reliable operation.

While only one embodiment of my invention has been shown, it will be appreciated that modifications thereof, some of which have been alluded to hereinabove such as the shape of the housing 32, the number and arrangement of the multiplicity of jets 40, 40 prine, etc., may still be readily made thereto by those skilled in the art. I, therefore, intend by the appended claims to cover the modifications alluded to herein, as well as all other modifications which fall within the true spirit and scope of my invention.

What is claimed is:

1. In an air heater or small industrial furnace including a body supported on a frame structure, said body including a closed combustion chamber of restricted dimensions formed internally thereof, said body further having an opening formed in one end thereof so as to be located in coaxial alignment with the major axis of said combustion chamber, said combustion chamber being lined internally with a refractory material, the improvement comprising a burner fixedly mounted in said opening in said body operative for effecting the burning in said combustion chamber of pulverized coal with a stable flame of relatively short length so as to produce a heat input to said combustion chamber of between one million and fifty million BTU/HR, said burner comprising:

a. a housing having a hollow interior operably defining a through chamber therewithin, said through chamber having a first end and a second end, said second end being spaced in a first direction from said first end so as to thereby define the major axis of said housing;

b. first inlet means provided at said first end of said housing;

c. feed means connected in fluid flow relation to said first inlet means for feeding a previously formulated combustible mixture of pulverized coal and air to said housing;

d. a multiplicity of jet means fixedly mounted in a prescribed array within said through chamber formed in said housing, each of said multiplicity of jet means comprising a pipe-like jet having a length at least equal to the length of said housing, each of said pipe-like jets being supported within said through chamber so as to extend the length of said through chamber and so as to be in parallel relation to the major axis of said housing, each of said pipe-like jets having one end thereof connected in fluid flow relation with said first inlet means for receiving therefrom a substantially equal portion of the mixture of pulverized coal and air being fed to said first inlet means by said feed means, each of said pipe-like jets being operative as a conduit through said housing for that portion of the mixture of pulverized coal and air received at said one end thereof;

e. a deflector plate fixedly mounted to said housing so as to be interposed between said first inlet means and said one end of each of said pipe-like jets, said deflector plate having a plurality of openings formed therethrough corresponding in number to the number of said pipe-like jets, each of said plurality of openings provided in said deflector plate being aligned with said one end of each of a corresponding one of said pipe-like jets, deflector plate being operative to divide the previously formulated combustible mixture of pulverized coal and air received at said first inlet means into a plurality of smaller, substantially equal portions thereof and to guide one of the plurality of smaller, substantially equal portions of the combustible mixture of pulverized coal and air into said one end of each of a corresponding one of said pipe-like jets;

f. outlet means formed at said second end of said housing, said outlet means being connected in fluid flow relation with the other end of said pipe-like jets, said outlet means being operative to effect the collective discharge from said housing of all of the smaller, substantially equal portions of the combustible mixture of pulverized coal and air flowing through each of said pipe-like jets into said combustion chamber whereupon the collective burning of all of the smaller, substantially equal portions of the combustible mixture of pulverized coal and air is operative to provide a heat input to said combustion chamber of between one million and fifty million BTU/HR with a stable flame having a relatively short length so as to be suitable for employment in said combustion chamber despite the dimensional limitations thereof; and g. second inlet means provided in said housing at said first end thereof in spaced relation to said first inlet means, said second inlet means being connectible to a source of additional air, said second inlet means being operative to introduce a supply of additional air into said housing for passage through said through chamber in surrounding relation to each of said pipe-like jets followed by the subsequent discharge into said combustion chamber of this additional air from said housing at said second end thereof.

2. In an air heater or small industrial furnace, the improvement of a burner as set forth in claim 1 wherein said multiplicity of jet means comprises nine pipe-like jets with eight of said pipe-like jets positioned in equally spaced relation one to another in a circular array around the major axis of said housing and with the remaining one of said nine pipe-like jets positioned on the major axis of said housing, and wherein said burner further includes a plurality of spacer members interposed between said nine pipe-like jets in supporting relation thereto.

* * * * *

UNITED STATES PATENT AND TRADEMARK OFFICE

CERTIFICATE OF CORRECTION

PATENT NO. : 4,257,761

DATED : March 24, 1981

INVENTOR(S) : Richard L. Musto

It is certified that error appears in the above—identified patent and that said Letters Patent is hereby corrected as shown below:

In the ABSTRACT, line 14, "where" should read --whence--.

Column 3, line 43, "an" should be deleted.

Column 3, line 54, "ivnention" should read --invention--.

Column 3, line 64, "employing" should read --employment--.

Column 4, line 60, "FIG." should read --FIGS.--.

Column 5, line 12, "FIG." should read --FIGS.--.

Column 6, line 22, "numberal" should read --numeral--.

Column 8, line 64, "primay" should read --primary--.

Column 9, line 9, "preferably" should read --Preferably--.

Column 10, line 27, "of" should read --to--.

Column 10, line 48, after "flange", --member-- should be inserted.

Column 11, line 56, "prine" should read --prime--.

Column 12, line 48, before "deflector", --said-- should be inserted.

Signed and Sealed this

*Thirtieth* Day of *June 1981*

[SEAL]

*Attest:*

RENE D. TEGTMEYER

*Attesting Officer*

*Acting Commissioner of Patents and Trademarks*